US011130659B2

(12) United States Patent
Muller

(10) Patent No.: US 11,130,659 B2
(45) Date of Patent: Sep. 28, 2021

(54) TELESCOPING JIB COMPRISING A ROD GUYING SYSTEM FOR A MOBILE CRANE AND GUYING METHOD THEREFOR

(71) Applicant: Tadano Demag GmbH, Zweibrücken (DE)

(72) Inventor: Laurent Muller, Butten (FR)

(73) Assignee: Tadano Demag GmbH, Zweibrücken (DE)

( * ) Notice: Subject to any disclaimer, the term of this patent is extended or adjusted under 35 U.S.C. 154(b) by 157 days.

(21) Appl. No.: 16/477,651

(22) PCT Filed: Jan. 17, 2018

(86) PCT No.: PCT/EP2018/051105
§ 371 (c)(1),
(2) Date: Jul. 12, 2019

(87) PCT Pub. No.: WO2018/134249
PCT Pub. Date: Jul. 26, 2018

(65) Prior Publication Data

US 2019/0359457 A1 Nov. 28, 2019

(30) Foreign Application Priority Data

Jan. 20, 2017 (DE) ..... 10 2017 101 113.7

(51) Int. Cl.
*B66C 23/70* (2006.01)

(52) U.S. Cl.
CPC .... *B66C 23/706* (2013.01); *B66C 2700/0371* (2013.01)

(58) Field of Classification Search
CPC ..... B66C 23/66; B66C 23/706; B66C 23/707; B66C 23/708; B66C 23/826; B66C 23/78
See application file for complete search history.

(56) References Cited

U.S. PATENT DOCUMENTS 1,325,053 A 12/1919 Steidle
2,449,703 A 9/1948 Johnson
(Continued)

FOREIGN PATENT DOCUMENTS

CN 201272663 Y 7/2009
CN 101857176 A 10/2010
(Continued)

OTHER PUBLICATIONS

International Search Report of the International Searching Authority from corresponding Patent Cooperation Treaty (PCT) Application No. PCT/EP2018/051105 indicated completed on Apr. 5, 2018.
(Continued)

*Primary Examiner* — Emmanuel M Marcelo
(74) *Attorney, Agent, or Firm* — Gardner, Linn, Burkhart & Ondersma LLP

(57) ABSTRACT

A telescoping jib of a mobile crane includes sections that telescope out of a jib housing from a transport position into an operating position. A guying system has successively connected tension rods extending from the jib housing to at least one of the extended telescoping jibs by at least one guying support. The mobile crane provides a lighter construction and improved road handling, and an increased load capacity for unchanged telescoping jib measurements. To this end, a guide holder arranged on the jib housing receives the tension rods in the transport position and, in the operating position, at least one movable tension rod on one of the guying supports is respectively securely connected to the outer end of a telescoping section head in an articulated manner and can be secured to a holding mechanism on the opposite end on an adjacent guying support of an adjacent telescoping section head.

20 Claims, 5 Drawing Sheets

(56) References Cited

U.S. PATENT DOCUMENTS

| | | | | |
|---|---|---|---|---|
| 3,830,376 | A * | 8/1974 | Fritsch | B66C 23/707 212/350 |
| 4,004,695 | A * | 1/1977 | Hockensmith | B66C 23/701 212/350 |
| 4,360,111 | A | 11/1982 | Weiskopf | |
| 4,982,853 | A | 1/1991 | Kishi | |
| 9,637,358 | B2 * | 5/2017 | Knecht | B66C 23/42 |
| 2002/0070187 | A1 | 6/2002 | Willim | |
| 2004/0129663 | A1 * | 7/2004 | Willim | B66C 23/701 212/177 |
| 2008/0169258 | A1 * | 7/2008 | Weisbauer | B66C 23/78 212/296 |
| 2018/0044149 | A1 | 2/2018 | Weckbecker et al. | |
| 2018/0327234 | A1 | 11/2018 | Martin et al. | |
| 2018/0339889 | A1 | 11/2018 | Kuhn et al. | |
| 2018/0346291 | A1 | 12/2018 | Martin et al. | |
| 2018/0346292 | A1 | 12/2018 | Kuhn et al. | |
| 2020/0189888 | A1 | 6/2020 | Muller | |

FOREIGN PATENT DOCUMENTS

| | | | |
|---|---|---|---|
| CN | 202558505 | U | 11/2012 |
| CN | 104555760 | A | 4/2015 |
| DE | 3447095 | C2 | 4/1995 |
| DE | 10062517 | C2 | 12/2002 |
| DE | 20203443 | | 5/2003 |
| DE | 20208740 | U1 | 10/2003 |
| DE | 20219126 | U1 | 4/2004 |
| DE | 10315989 | A1 | 11/2004 |
| DE | 102015009156 | A1 | 2/2016 |
| EP | 1213254 | A1 | 6/2002 |
| EP | 1266861 | A1 | 12/2002 |
| EP | 1354842 | B1 | 12/2004 |
| EP | 2504267 | A1 | 10/2012 |

OTHER PUBLICATIONS

Written Opinion of the International Searching Authority from corresponding Patent Cooperation Treaty (PCT) Application No. PCT/EP2018/051105, indicated completed on Apr. 5, 2018.

Preliminary Report on Patentability of International Searching Authority in English from corresponding Patent Cooperation Treaty (PCT) Application No. PCT/EP2018/051105, completed Jul. 23, 2019.

* cited by examiner

TELESCOPING JIB COMPRISING A ROD GUYING SYSTEM FOR A MOBILE CRANE AND GUYING METHOD THEREFOR

CROSS REFERENCE TO RELATED APPLICATION

The present application claims the priority benefits of International Patent Application No. PCT/EP2018/051105, filed Jan. 17, 2018, and claims benefit of DE 102017101113.7, filed on Jan. 20, 2017.

BACKGROUND AND FIELD OF THE INVENTION

The invention relates to a telescoping jib of a mobile crane comprising a plurality of telescoping sections which can be telescoped out of a jib basic box from a transport position to an operating position, and comprising a guying system for guying the telescoping jib, which comprises a plurality of successively mutually connected tension rods which extend from the jib basic box via at least one guying support to at least one of the extended telescoping jibs.

Moreover, the invention relates to a method for guying a telescoping jib of a mobile crane, in which a plurality of successively mutually connected tension rods are guyed between a jib basic box of a telescoping jib and at least one adjoining telescoping section of the telescoping jib.

A telescoping crane jib is known from the German laid-open document DE 10 2015 009 156 A1. The crane jib consists of a base section and one or more telescoping sections. In order to increase the load-bearing capacity of the crane jib a guying arrangement is provided consisting of a single pair of guying supports and traction means. The pair of guying supports is arranged in a v shape on a head end of a first telescoping section and extends perpendicularly to the crane jib. The traction means are on the one hand fastened at a foot end of the base section to cable winches and on the other hand to a head end of a second telescoping section. The two traction means also extend along the crane jib and are each guided via one of the two guying supports in the region of their free ends. For this purpose deflecting rollers are arranged on each of the guying supports and the respective cable is looped around them at least once. Each deflecting roller can be fixed via a holding function. The traction means are wound or unwound by the cable winches as the crane jib is being retracted and extended and are then tensioned after extension has taken place. After tensioning, the deflecting rollers are also fixed. The tensioning of the traction means causes the crane jib to be relieved of loading, and sagging of the crane jib is reduced or avoided.

Furthermore, the German patent document DE 34 47 095 C2 discloses a further telescoping jib on a superstructure of a crane. The telescoping jib is guyed by an arrangement of tensioning cables and deflecting rollers. The tensioning cables are each fastened to each foot end of the respective telescoping sections, are deflected in each case at each head end of the respective adjoining and outer telescoping sections via one of the deflecting rollers and come together at a tensioning cylinder attached to the superstructure.

Furthermore, a mobile crane with a telescoping crane jib with three telescoping partial jibs is known from the European patent document EP 2 504 267 B1. The partial jibs extend in parallel and spaced apart from each other. The spacing is achieved via triangular connection plates, the partial jibs respectively extending in the corners thereof. The connection plates are each arranged in the region of head ends of the partial jibs and at a foot end of the base partial jib.

A mobile crane comprising a telescoping jib, in which cables and rods are used as guying means, is also known from the further European patent document EP 1 354 842 B1.

The German patent DE 100 62 517 C2 relates to a guying system for a telescoping jib of a vehicle crane. The telescoping jib typically has a basic box, on which a guying bracket is arranged at a right angle. A rear guying arrangement leads from a free end of the guying bracket to the foot region of the basic box. A front guying arrangement is connected to the free end of the guying bracket and to the head piece or to a collar of one of the inner boxes of the telescoping jib. In order to dispense with cable winches, the front guying arrangement is formed over its length by a number of mutually connectable traction elements each having a fixed length, in order to adjust the desired traction force. The fixed lengths of the traction elements are dimensioned such that a specific number of traction elements corresponds to a specified discrete extension length of the telescoping jib.

The U.S. Pat. No. 4,982,853 discloses a guying system for a multiple-stage telescoping jib, wherein a guying support is attached to the foot of the basic box and further guying supports are each attached to the collar of the basic box or to the collar of an inner box. Located between the guying supports are tensioning cables, wherein the tensioning cable is attached to the tensioning support and to the head of the telescoping jib.

The Chinese utility model CN 202 558 505 U describes a guying system for a telescoping jib, wherein three guying cables are guided from a head of the telescoping jib via, in each case, a front guying support and a rear guying support with a cable deflecting roller to a foot of the basic box.

SUMMARY OF THE INVENTION

The object of the invention is to create a telescoping jib for a mobile crane with a rod guying system and a guying method therefor, which are characterised by a lighter construction and improved handling during operation on roads and an increase in the bearing load while the telescoping jib dimensions remain unchanged.

In accordance with an aspect of the invention, in the case of a telescoping jib of a mobile crane comprising a plurality of telescoping sections which can be telescoped out of a jib basic box from a transport position to an operating position, and comprising a guying system for guying the telescoping jib, which comprises a plurality of successively mutually connected tension rods which extend from the jib basic box via at least one guying support to at least one of the extended telescoping jibs, an increase in the bearing load and a lighter construction are achieved by virtue of the fact that a guide holder for the displaceable tension rods is arranged on the jib basic box and receives the displaceable tension rods in the transport position of the telescoping jib and in the operating position in each case at least one of the displaceable tension rods on one of the guying supports is fixedly articulated in each case to the outer end of the telescoping section head and can be fixed to a holding mechanism on the opposite end on an adjacent guying support of an adjacent telescoping section head. As a result, reduced setting-up times between road operation and crane operation are also achieved. The guying system as a whole is carried along on the mobile crane, in particular on the jib basic box. In this case, the displaceable tension rods can each advantageously be extended out of, or retracted into, the allocated guide holder.

A space-saving implementation of the guying system is achieved in that each guying support is arranged in each case at the outer end of a jib basic box head or of a telescoping section head.

In a further embodiment of the invention, provision is made that a guying support is arranged in each case on the jib basic box and on each telescoping section. The telescoping jib can thus be guyed at a plurality of points, which in turn increases the stability of the guying arrangement and improves the bearing load of the telescoping jib. A lighter and smaller construction can thus also be implemented for the same bearing load.

The guying system is simplified in structural terms by virtue of the fact that each guying support has an opening for the displaceable tension rods to be guided there through, and the holding mechanism for the respective displaceable tension rod is arranged in the region of the opening.

In order to implement the guying system in a particularly simple manner, provision is made that the holding mechanism comprises a movable locking bar element, by means of which the respective tension rod in the opening can be fixed in the operating position by engagement into a recess in the respective tension rod.

A further improvement in the stability and bearing load of the telescoping jib is provided by virtue of the fact that each guying support comprises two limbs which are arranged on the telescoping jib to the right and left of a centre of the telescoping jib, as seen in the longitudinal direction of the telescoping jib, and form an angle of 45° to 135°, preferably 90°.

In a further embodiment of the invention, provision is made that at least one tension rod is fixedly articulated to each limb of each guying support and/or can be fixed to the holding mechanism.

In a typical manner, provision is made that the successive telescoping sections and the jib basic box can be secured to one another.

Moreover, the construction height of the mobile crane for road operation is maintained by virtue of the fact that by means of an erecting mechanism which connects the guide holders of the guying system to the jib basic box via a guying support, the guide holders can be erected from a transport position to an operating position and, in the operating position, the guide holders and the displaceable tension rods resting thereon extend in parallel with a longitudinal direction and above the telescoping jib.

In order to ensure that the guide holders and displaceable tension rods can pivot in a space-saving manner, provision is made that the guide holders can be pivoted from the transport position to the operating position via articulation points, the articulation points are arranged over the course of the guide holders and adjoining the guying support, the displaceable tension rods in the transport position on the guide holders have articulation points which are aligned with the articulation points of the guide holders.

In relation to the first guying support on the head of the jib basic box, a guying arrangement is provided via left and right positionally fixed tension rods on the jib basic box in the region of the foot thereof.

A simplified and space-saving method for guying a telescoping jib, in which a plurality of successively mutually connected tension rods are guyed between a jib basic box of a telescoping jib and at least one adjoining telescoping section of the telescoping jib, is achieved by virtue of the fact that, together with successively extending the individual telescoping sections from the jib basic box in each case one of the tension rods is extended from a guide holder from a transport position to an operating position and each tension rod in the operating position is fixed to a guying support of the adjacent telescoping section via a holding mechanism.

An exemplified embodiment of the invention is explained in greater detail hereinafter.

DESCRIPTION OF THE PREFERRED EMBODIMENTS

Figure 1:
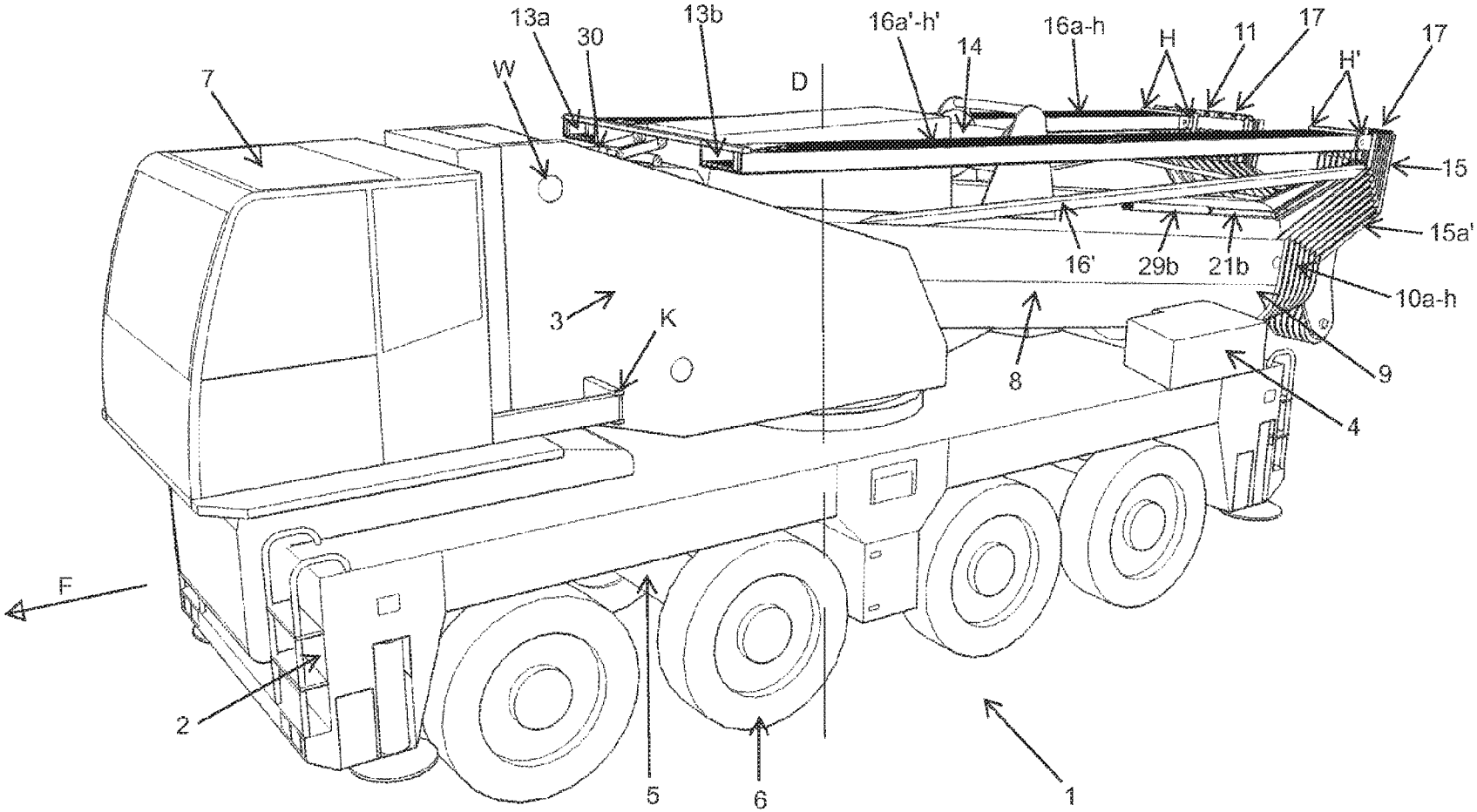
FIG. 1 shows a perspective view of a mobile crane with a telescoping jib.

FIG. 1 shows a perspective view of a mobile crane designated by 1. The mobile crane 1 comprises essentially a lower carriage 2 and a superstructure 3. The lower carriage 2 supports counterweights 4 and comprises four vehicle axles 5 each with two wheels 6 suitable for road travel. Of course, the lower carriage 2 can also be equipped with more or fewer than four vehicle axles 5. Furthermore, the lower carriage 2 supports the superstructure 3, which can pivot with respect to the lower carriage 2 about a substantially vertically orientated axis of rotation D The superstructure 3 and lower carriage 2 can naturally also be rigidly mounted one on another. Arranged on the superstructure 3 is a combined driver's and crane operator's cabin 7 which can be pivoted about a vertical axis K from the front—as seen in the forwards travel direction F of the mobile crane 1—to the rear and vice versa. The combined driver's and crane operator's cabin 7 is thus located behind the superstructure 3 in the driving position and to the side next to the superstructure 3 in the crane operating position. Moreover, the superstructure has a luffable telescoping jib 8 mounted thereon which, for road travel, is completely retracted and, in the direction opposite the forwards travel direction F of the mobile crane 1, is stored on the lower carriage 2 in a downwardly inclined manner at a shallow angle proceeding from a horizontal, so that guying supports 15 arranged on the telescoping jib 8 and protruding upwards do not increase the construction height during travel of the mobile crane 1. It is naturally also possible to form the driver's and crane operator's cabin 7 separately from each other.

The telescoping jib 8 typically consists of a jib basic box 9 and a plurality of extendible and retractable telescoping sections 10*a-h* and has a guying system 11 in order to achieve an increase in the bearing load with the telescoping jib 8 remaining otherwise unchanged. With this guying system, it is also possible to produce telescoping jibs 8 with smaller diameters or cross-sections whilst maintaining the bearing load. The guying system 11 consists substantially of a multiplicity of tension rods 16, 16', 16*a*-16*h*, 16*a*'-16*h*', of which the displaceable tension rods 16*a-h*, 16*a*'-h' can be retracted and extended in parallel with the telescoping sections 10*a*-10*h*. In FIG. 1, the tension rods 16*a*-16*h*, 16*a*'-16*h*' are completely retracted for road travel and rest above the jib basic box 9 in left and right guide holders 13*a*, 13*b*. Also, for road travel the left and right guide holders 13*a*, 13*b* are pivoted together with the tension rods 16*a*-16*h*, 16*a*'-16*h*' to a rest position in order not to increase the construction height of the mobile crane 1.

Figure 2:
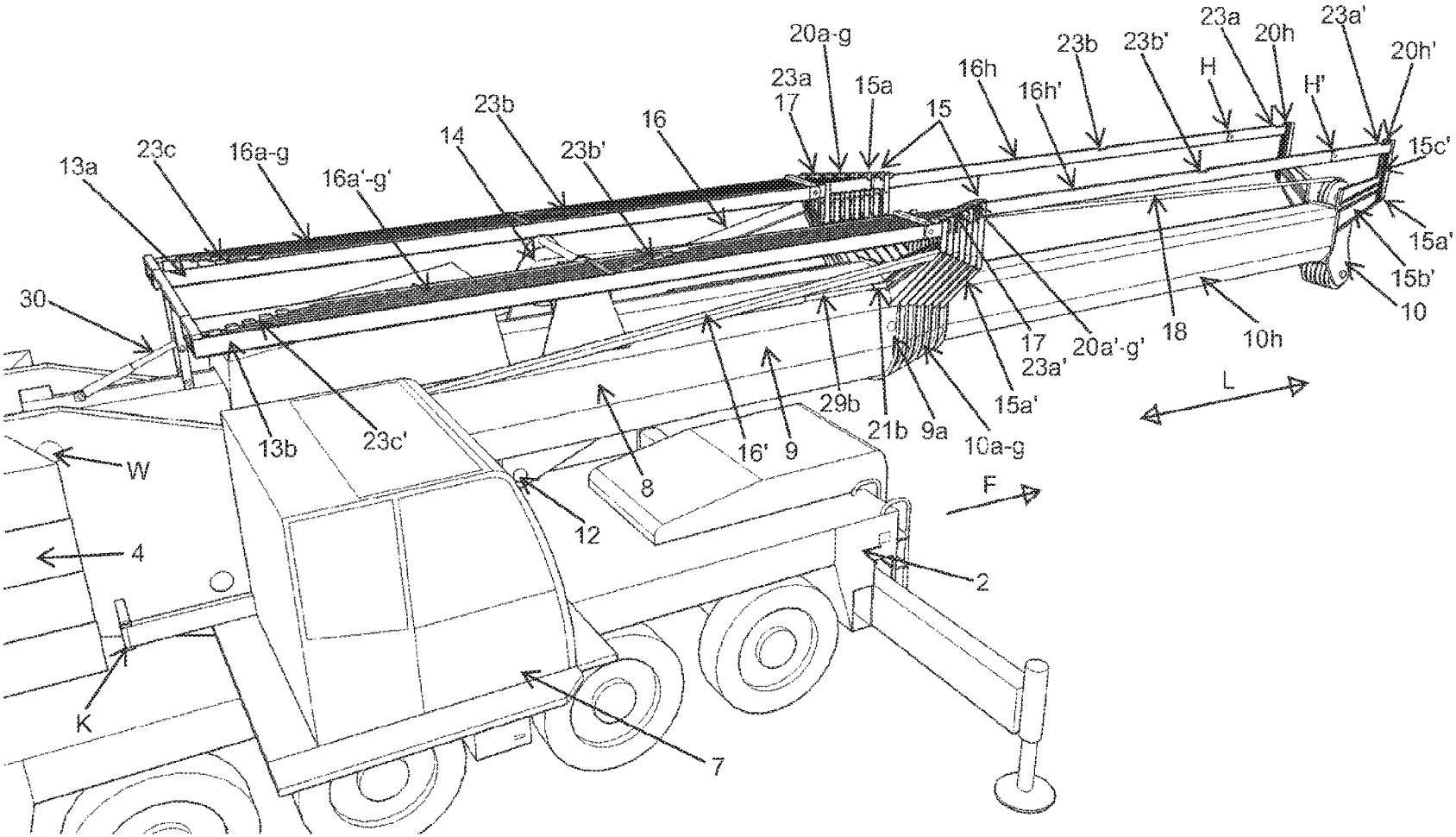
FIG. 2 shows a perspective partial view of a mobile crane according to FIG. 1 with a partially extended telescoping jib.

The jib basic box 9 is typically connected at its foot to the superstructure 3 via a horizontal luffing axle W and can be pivoted up and down via a luffing cylinder 12 (see FIG. 2). The jib basic box 9 receives the telescoping sections 10*a*-*h* within it in a conventional manner, these each being arranged one inside another and being retractable and extendible. In the respectively extended condition, the telescoping sections 10*a*-*h* are connected to one another via bolts, not illustrated. The foot of the inner, and therefore smaller, telescoping section 10*a*-*h* is in each case bolted, by means of a fitting bolting position hole, to the next outer and larger telescoping section 10*a*-*h* in each case or to the jib basic box 9. In FIG. 2, the foot of the telescoping section 10*h* is therefore connected to the head 10 of the telescoping section 10*g* via the bolts, not illustrated.

FIG. 2 illustrates a perspective partial view of the mobile crane 1 according to FIG. 1 with a partially extended telescoping jib 8. The innermost and therefore uppermost telescoping section 10*h* is extended, the remaining telescoping sections 10*a*-*g* are still retracted. For crane operation, the superstructure 3 is pivoted out of the position for road travel (see in this respect FIG. 1) by 180° and so the telescoping jib 8 points in the forwards direction of travel F and creates space for arranging counterweights 4 on the rear side of the superstructure 3. The driver's and crane operator's cabin 7 has now been displaced laterally next to the superstructure 3 for crane operation.

It is also apparent from FIG. 2 that, as seen in the longitudinal direction L of the telescoping jib 8, a lifting mechanism 14 having a cable drum is arranged on the jib basic box 9 for the purpose of lifting and lowering the crane loads. The cable drum of the lifting mechanism 14 points upwards and its rolling axis is arranged at a right angle to the longitudinal direction L of the telescoping jib 8 (see also FIG. 3). A lifting cable 18 is wound and unwound by the lifting mechanism 14 and extends from the lifting mechanism 14 along and above the telescoping jib 8 to the end of the last telescoping section 10*h*. Located at the end of the last telescoping section 10*h* are a deflecting roller 19 and a guide roller 31 (see FIG. 3), over which the lifting cable 18 is guided.

In addition to the multiplicity of tension rods 16, 16', 16*a*-16*h*, 16*a*'-16*h*', the guying system 11 comprises substantially v-shaped and fork-shaped guying supports 15 which are arranged on the outer end—as seen in the longitudinal direction L of the telescoping jib 8—of a head 9*a* of the jib basic box 9 or a head 10 of each telescoping section 10*a*-*h*. Each v-shaped and fork-shaped guying support 15 comprises a left limb 15*a* and a right limb 15*a*'. Each of the left and right limbs 15, 15*a*' consists of a lower part 15*b*, 15*b*' and an upper part 15*c*, 15*c*'. The two lower limbs 15*b*, 15*b*' adjoin one another—as seen with the telescoping jib 8 orientated horizontally—on the outside and at the top in the region of corners of the telescoping sections 10*a*-*h*, which have a substantially four-sided cross-section, or of the jib basic box 9, which has a substantially four-sided cross-section, and extend upwards and outwards in an inclined manner at approximately an angle of 45°. The upper free ends of the lower parts 15*b*, 15*b*' are adjoined as one piece by the upper parts 15*c*, 15*c*' in an inclined manner at approximately an angle of 45° so as to extend vertically upwards.

The telescoping jib 8 is guyed by the positionally fixed jib basic box-tension rods 16, 16' on the jib basic box 9 and the displaceable tension rods 16*a*-*h*, 16*a*'-h in each case in conjunction with the guying supports. The left and right positionally fixed tension rods 16, 16' extend in a transport position at a shallow angle to the longitudinal direction L of the telescoping jib 8 and are each fastened at one end to the associated guying support 15 in the transition region between its lower and upper limbs 15*b*, 15*b*', 15*c*, 15*c*' and are connected to the other end in the lateral region of the foot of the jib basic box 9. Therefore, the tensioning forces acting upon the first guying support 15 of the jib basic box 9 are introduced into the jib basic box 9 via the positionally fixed tension rods 16, 16. In the retracted condition, the displaceable tension rods 16*a*-*h*, 16*a*'-h' are stored on left and right guide holders 13*a*, 13*b*. Each of these guide holders 13*a*, 13*b* is designed as a flat, u-shaped profile which is open at the top and has u-shaped guide tracks for each of the displaceable tension rods 16*a*-*h*, 16*a*'-h' and serves as a magazine for the displaceable tension rods 16*a*-*h*, 16*a*'-h' when the telescoping jib 8 is retracted. The guide holders 13*a*, 13*b* are articulated at the upper end of the limb 15*a*, 15*a*' of the guying support 15 on the head of the jib basic box 9*a* in each case at the head so as to be pivotable about an articulation point H, H' having a horizontal axis. At the opposite foot, the guide holders 13*a*, 13*b* are mounted with an erecting mechanism 30 on the foot of jib basic box 9. Prior to luffing up and extending the telescoping jib 8, the guide holders 13*a*, 13*b* are pivoted upwards from their transport position to an operating position with the displaceable tension rods 16*a*-*h*, 16*a*'-h' by means of the knee lever-like erecting mechanism 30 via an auxiliary cylinder. In this operating position, the displaceable tension rods 16*a*-*h*, 16*a*'-h' and the guide holders 13*a*, 13*b* extend in parallel and above the telescoping jib 8.

In order to permit the previously described movement of the guide holders 13*a*, 13*b* from the transport position to the operating position and also to benefit from the advantage of the reduced construction height in the transport position, not only the guide holders 13*a*, 13*b* but also the displaceable tension rods 16*a*-*h*, 16*a*'-h' have to be designed in an articulated manner with articulation points H, H'. Each of the displaceable tension rods 16*a*-*h*, 16*a*'-h' is thus designed at least in two parts with an articulation point H, H'. These articulation points H, H' of all of the displaceable tension rods 16*a*-*h*, 16*a*'-h' and also the guide holders 13*a*, 13*b* lie on a common, notional, horizontal axis in the transport position of the guide holders 13*a*, 13*b* and the telescoping jib 8. In relation to an extended pair of the first or uppermost displaceable tension rods 16*h*, 16*h*', it is apparent from FIG. 2 that the displaceable tension rods 16*h*, 16*h*' have an articulation point H, H' in the vicinity of the uppermost guying support 15. The spacing between the articulation point H, H' and the fixed connection of the displaceable tension rods 16*h*, 16*h*' on the uppermost guying support 15 corresponds to the spacing between the uppermost guying support 15 and the articulation point H, H' of the guide holders 13*a*, 13*b* in the transport position of the telescoping jib 8. Corresponding articulation points H, H' and associated spacings can also be found in the case of all of the other displaceable tension rods 16*h*, 16*h*', even though they are not illustrated in the drawing.

The displaceable tension rods 16*a*-*h*, 16*a*'-h which, in the extended condition of the telescoping cylinder 8, are each connected to one another via the guying supports 15 thus form a cable-like, flexible construction, similar to a link chain, via the multiplicity of articulation points H, H'.

Figure 3:
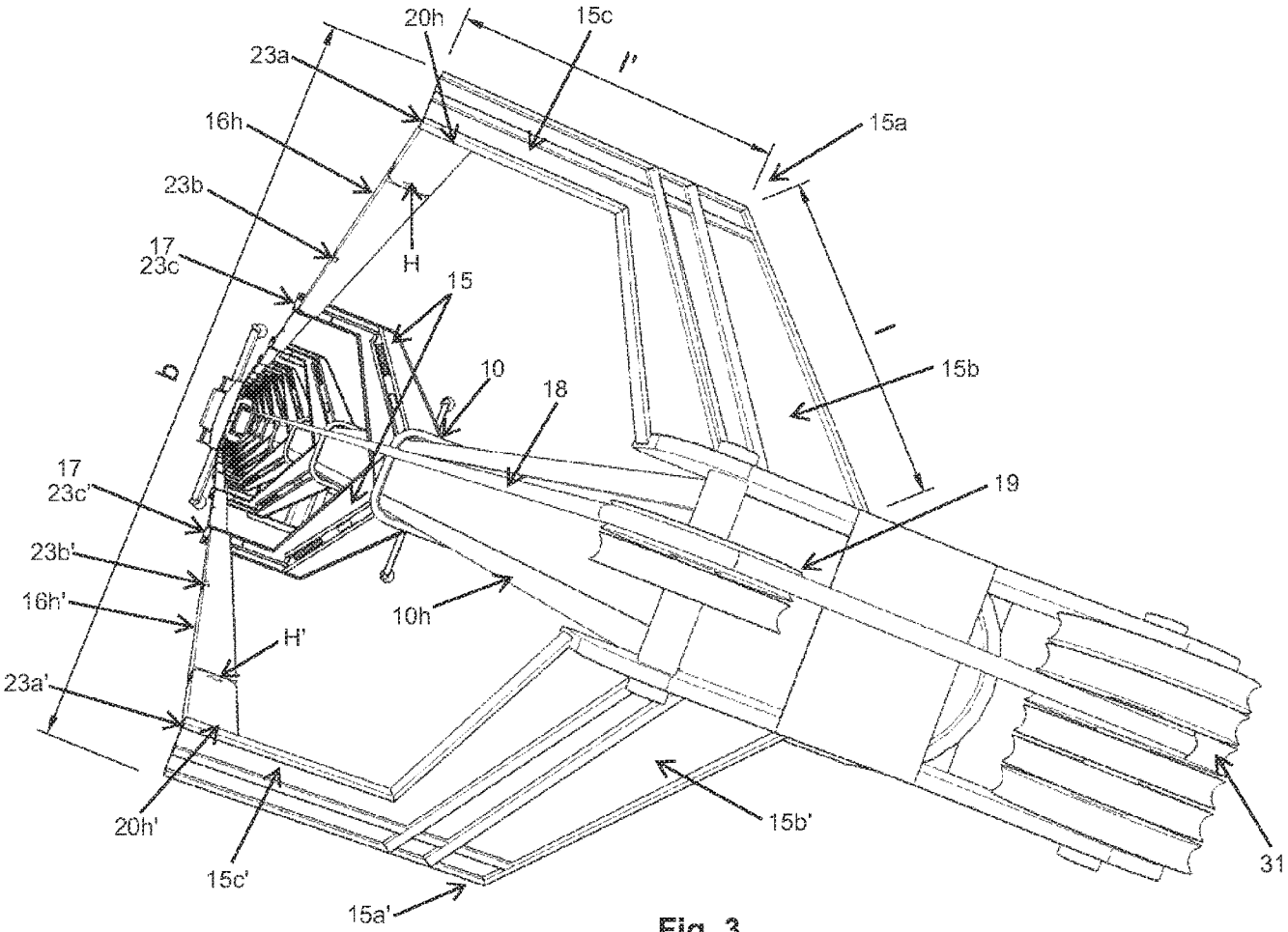
FIG. 3 shows a perspective plan view of a completely extended telescoping jib.

FIG. 3 shows a perspective plan view, at an angle from above, of a completely extended telescoping jib 8. The guying supports 15 are arranged on each telescoping section head 10 and on the jib basic box head 9*a* and therefore spaced apart from one another. The limbs 15*a* and 15*a*' of the guying support 15 are arranged on the telescoping jib 8 laterally to the right and left. The opposite upper parts 15*c*, 15*c*' of the guying supports 15 have a spacing b with respect to one another. In relation to the displaceable tension rods 16*h*, 16*h*', the associated articulation points H, H" are illustrated in the vicinity of the uppermost guying support 15. Each of the displaceable tension rods 16*a-h*, 16*a*'-h' is thus designed in two parts.

It is also apparent from FIG. 3 that the lower parts 15*b*, 15*b*' have a first length I and the upper parts 15*c*, 15*c*' have a second length I'. Since the displaceable tension rods 16*a-h*, 16*a*'-h' in the operating position are arranged substantially aligned with one another along the telescoping jib 8, the first and further lengths I, I' are to be adapted accordingly because the diameters of the telescoping sections 10*a-h* decrease from the jib basic box 9 and therefore this is compensated for by an associated increase in the lengths I, I'.

Figure 4:
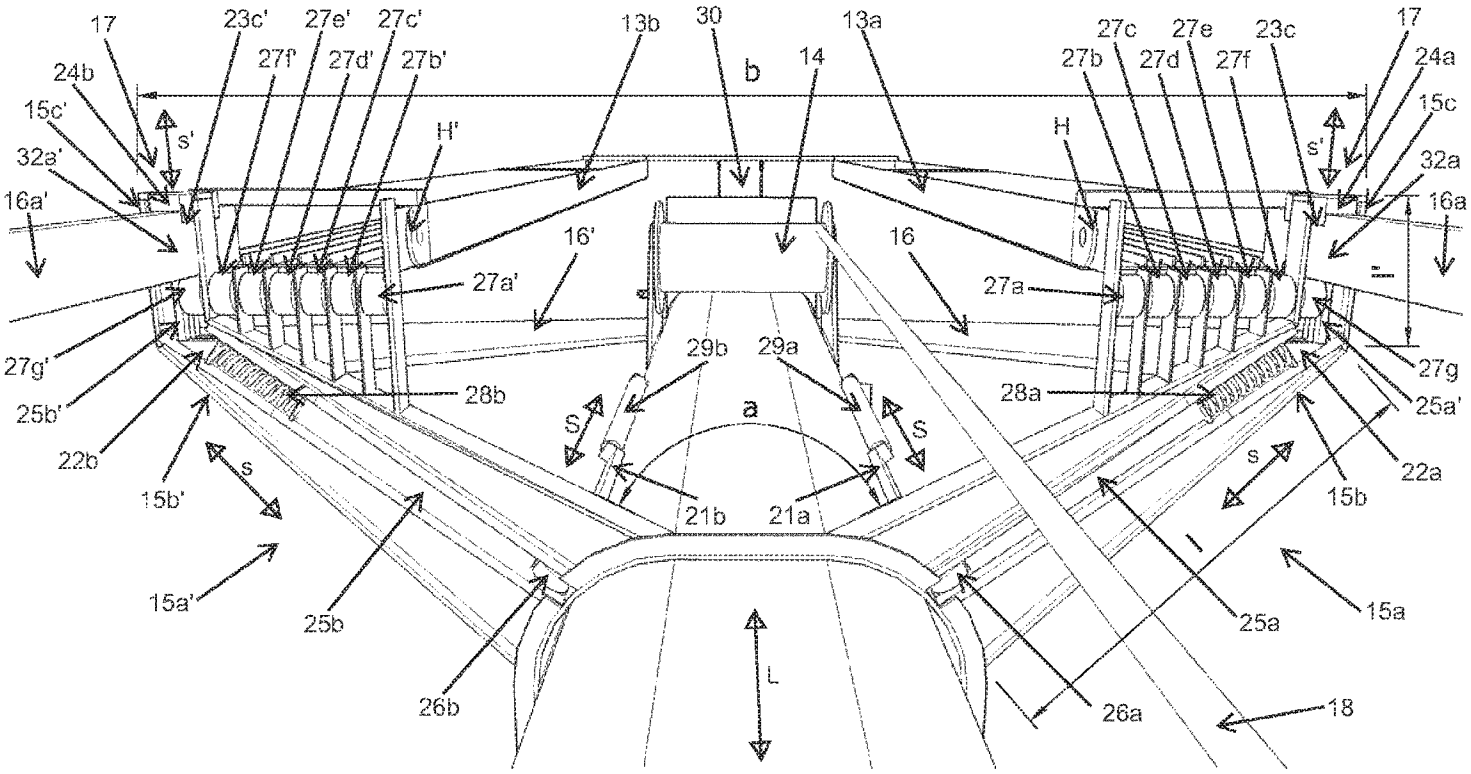
FIG. 4 shows a detailed view of a guying support on a jib basic box of the telescoping jib.

FIG. 4 shows a detailed view of a guying support 15 on a jib basic box 9 of the telescoping jib 8. Since, in the present case, no displaceable tension rods 16*a-h*, 16*a*'-h' are stored in the guide holder 13*a*, 13*b*, all of the telescoping sections 10*a*-10*h* are at least partially extended. It is also evident that an opening angle a of the two limbs 15*a* and 15*a*' amounts to approximately 45° to 135°, preferably 90°. In this case, both limbs 15*a* and 15*a*' lie in a common notional plane which is orientated at a right angle to a longitudinal direction L of the telescoping jib 8. The lower parts 15*b*, 15*b*' of the two limbs 15*a*, 15*a*' themselves have a stretched triangle-like shape with the respectively adjoining vertical upper part 15*c*, 15*c*', wherein a base side of the triangle lies against the telescoping section 10*a-h* or against the jib basic box 9.

Arranged in each case in the upper parts 15*c*, 15*c*' of the limbs 15*a*, 15*a*' is an actuatable holding mechanism 17 for securing the displaceable tension rods 16*a-h*, 16*a*'-h'. As already previously described, the displaceable tension rods 16*a-h*, 16*a*'-h' are each fixedly arranged on the associated upper part 15*c*, 15*c*' of a guying support 15. An articulation point H, H' permits pivoting of the displaceable tension rods 16*a-h*, 16*a*'-h', which are retracted into the guide holders 13*a*, 13*b*, to the transport position. At the opposite end, the displaceable tension rods 16*a-h*, 16*a*'-h' are fixed to the upper ends of the upper parts 15*c*, 15*c*' of the limbs 15*a*, 15*a*' via the respective holding mechanism 17. Each of the holding mechanisms 17 consists substantially of a left or right locking bar element 24*a*, 24*b* which can be brought into engagement with a left or right recess 23*a-c*, 23*a*'-c', which is additionally formed corresponding thereto in a form-fitting manner, in the displaceable tension rods 16*a-h*, 16*a*'-h' (see in this respect also FIGS. 3 and 5). For each displaceable tension rod 16*a-h*, 16*a*'-h', three recesses 23*a-c*, 23*a*'-c' are each arranged in the longitudinal direction thereof at a spaced interval and successively: A first recess 23*a*, 23*a*' at the beginning of the displaceable tension rods 16*a-h*, 16*a*'-h' for fixing in the retracted condition of the respective telescoping section 10*a-h*, a second recess 23*b*, 23*b*' in the centre of the displaceable tension rods 16*a-h*, 16*a*'-h' for fixing in a respective half-extended telescoping section 10*a-h* and a third recess 23*c*, 23*c*' at the end of the displaceable tension rods 16*a-h*, 16*a*'-h' for fixing in a respective fully extended telescoping section 10*a-h*.

It is also evident in FIG. 4 (see also in this respect FIG. 5) that for each displaceable tension rod 16*a-h*, 16*a*'-h' on the guying supports 15 left and right running rollers 27*a-g*, 27*a*'-g' are arranged in and next to the upper limb 15*c*, 15*c*' in order to assist the extension and retraction movement of the respective displaceable tension rod 16*a-h*, 16*a*'-h' on each guying support 15.

Figure 5:
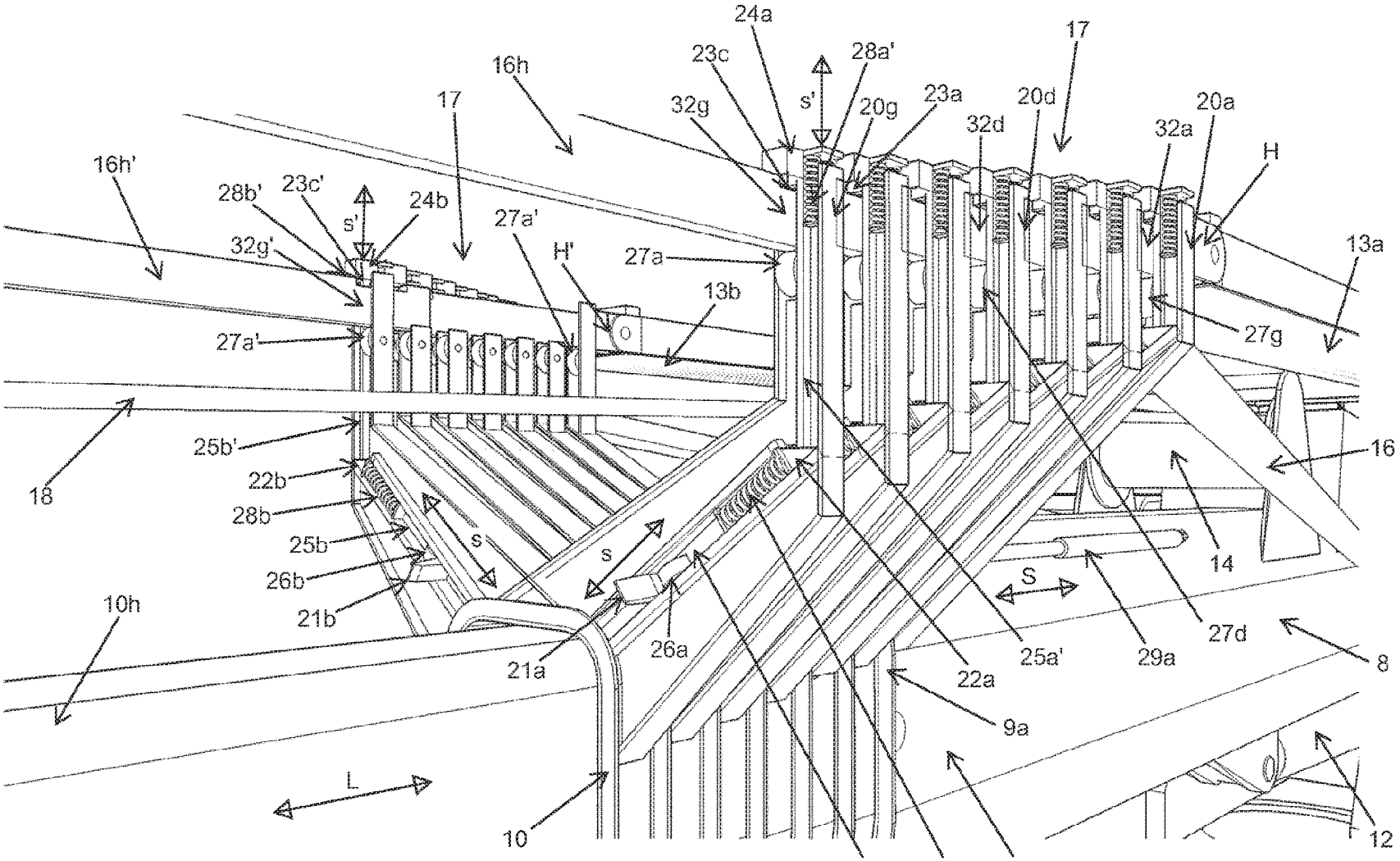
FIG. 5 shows a detailed view of the guying supports on the telescoping jib in the position according to FIG. 2 with open locking bar elements.

FIG. 5 shows a detailed view of seven of the total of eight guying supports 15 in the retracted condition of the telescoping sections 10*a-g*. In this predominantly retracted condition of the telescoping jib 8, the displaceable tension rods 16*a-g*, 16*a*'-g' are likewise retracted and are received by the guide holder 13*a*, 13*b*. When the telescoping jib 8 is being extended, the displaceable tension rods 16*a-h*, 16*a*'-h' run on running rollers 27*a-g*, 27*a*'-g' which are arranged in and next to the upper limbs 15*c*, 15*c*' of the limbs 15*a*, 15*a*'. In this case, the upper part 15*c*, 15*c*' of the limbs 15*a*, 15*a*' is provided in each case with an opening 32*a-g*, 32*a*'-g', in which the displaceable tension rods 16*a-h*, 16*a*'-h' are guided during the retraction and extension movement thereof. These openings 32*a-g*, 32*a*'-g' are defined at the bottom by the running rollers 27*a-g*, 27*a*'-g' and are defined at the top by the locking bar elements 24*a*, 24*b*. Said openings are defined laterally by walls of the upper parts 15*c*, 15*c*'.

FIG. 5 also shows the function of the holding mechanism 17 for fixing the displaceable tension rods 16*a-h*, 16*a*'-h' in the opening 32*a-g*, 32*a*'-g' to the desired extension length. In the preferred embodiment, the respective locking bar element 24*a*, 24*b* can be displaced in a sliding direction s' and thus in the longitudinal direction of the respective upper part 15*c*, 15*c*' from a lower locking position to an upper unlocking position. In the locking position, the locking bar element 24*a*, 24*b* is in engagement with the respective recess 23*a*, 23*a*' of the respective displaceable tension rod 16*a-h*, 16*a*'-h'. In the unlocking position, the locking bar element 24*a*, 24*b* is displaced upwards in the sliding direction s' until the locking bar element 24*a*, 24*b* is moved out of the respective recess 23*a*, 23*a*' and is thus located above the respective displaceable tension rod 16*a-h*, 16*a*'-h'. Moreover, the locking bar elements 24*a*, 24*b* are each pretensioned into the locking position via an upper spring element 28*a*' which acts downwards in the sliding direction s' and so a drive is required for movement into the unlocking position.

This drive for moving the locking bar elements 24*a*, 24*b* is configured as follows. Each of the locking bar elements 24*a*, 24*b* is adjoined laterally by a left or right upper sliding element 25*a*', 25*b*' which extends downwards to the beginning of the upper part 15*c*, 15*c*'. At this location, it lies on left and right wedge pieces 22*a*, 22*b* which each serve as a sliding link for a movement of the upper sliding elements 25*a*', 25*b*' in the sliding direction s' and mechanical force deflection. The left and right wedge pieces 22*a*, 22*b* are each fastened to upper ends of the right and left lower sliding element 25*a*, 25*b*. These sliding elements 25*a*, 25*b* have, at the lower end, a sliding roller 26*a*, 26*b*, are displaceable in a longitudinal direction of the lower parts 15*b*, 15*b*' in a sliding direction s and end at the lower end of the lower parts 15*b*, 15*b*' and thus face towards the surface of the respective telescoping section 10*a-h*. Like the upper sliding elements 25*a*', 25*b*', the lower sliding elements 25*a*, 25*b* are also pretensioned in each case via a lower spring element 28*a*, 28*b* in the direction of the lower end of the lower parts 15*b*, 15*b* and therefore in the locking direction of the locking bar elements 24*a*, 24*b*. In order to be able to move the respective lower sliding element 25*a*, 25*b* upwards in the sliding direction s and thus to move the locking bar elements 24*a*,

24*b* from the locking position to the unlocking position, a drive having a left and a right sliding cylinder 29*a*, 29*b* is provided. Attached to a free end of the piston rod of the sliding cylinder 29*a*, 29*b* is a respective sliding wedge 21*a*, 21*b* (see also in this respect FIG. 4), on which a lower end formed in the manner of a ramp is provided. The sliding wedges 21*a*, 21*b* are displaced below the left and right sliding roller 26*a*, 26*b* by extending the sliding cylinders 29*a*, 29*b* in order thus to raise the lower sliding element 25*a*, 25*b*, which is acted upon by the sliding rollers 26*a*, 26*b*, in the sliding direction S. The sliding cylinders 29*a*, 29*b* are arranged on the right and left in the region of the upper corners of the jib basic box 9 and can be retracted and extended in a sliding direction S.

Since, at the time of actuation of the respective locking bar elements 24*a*, 24*b* from the locking position to the unlocking position, the respective guying supports 15 still locally adjoin the head 9*a* of the jib basic box 9, all of the locking bar elements 24*a*, 24*b* can be actuated one after the other by the same sliding cylinders 29*a*, 29*b* via the sliding wedges 21*a*, 21*b*.

The function of the guying system 11 will be explained hereinafter with the aid of FIGS. 1 to 5. In a first step, the innermost telescoping section 10*h* of the telescoping jib 8 is extended together with its guying support 15. Since the displaceable tension rods 16*h*, 16*h*' are fastened to the guying support 15 in the rod fixed points 20*h*, 20*h*' of the limbs 15*a*, 15*a*' of the guying support 15, they are entrained simultaneously in the longitudinal direction L of the telescoping jib 8 and thus drawn out of the guide holders 13*a* and 13*b*. In this case, the displaceable tension rods 16*h*, 16*h*' are guided through the openings 32*g*, 32*g*' and on the running rollers 27*a*, 27*a*' of the guying supports 15 of the respectively next telescoping section 10*g* not yet extended in the longitudinal direction L. Upon reaching a desired bolting position of the innermost telescoping section 10*h*, the displaceable tension rods 16*h*, 16*h*' are fixed to the limbs 15*a*, 15*a*' by means of the two holding mechanisms 17 of the adjacent telescoping section 10*g* typically at half and full extension length. It is fundamentally possible to provide different bolting positions for each telescoping section 10*a-h*, these bolting positions then fixing a telescoping section 10*a-h* in a full or half or otherwise preselected extension path of the telescoping section 10*a-h*. In a similar manner, the displaceable tension rods 16*a-g*, 16*a-g*' are then successively tensioned in portions between the respective guying supports 15 of the telescoping sections 10*a-f* and of the jib basic box 9 in parallel with the extension and bolting of the further telescoping sections 10*a-f*.

The invention claimed is:

1. A telescoping jib of a mobile crane comprising:

a plurality of telescoping sections configured to be telescoped out of a jib basic box from a transport position to an operating position; and a guying system comprising a plurality of successively mutually connected tension rods which extend from the jib basic box via at least one guying support to at least one of the telescoping sections;

wherein a guide holder for the tension rods is arranged on the jib basic box and receives the tension rods in the transport position of the telescoping jib and, in the operating position, in each case at least one of the displaceable tension rods on one of the guying supports is fixedly articulated in each case to an outer end of a telescoping section head and can be fixed to a rod holder on an opposite end on an adjacent guying support of an adjacent telescoping section head.

2. The telescoping jib as claimed in claim 1, wherein each guying support is arranged in each case at an outer end of a jib basic box head or an outer end of the telescoping section head of the telescoping sections.

3. The telescoping jib as claimed in claim 2, wherein a one of the guying supports is arranged on a head of the jib basic box and is guyed to the jib basic box in the region of a foot of the jib basic box via left and right, positionally fixed tension rods.

4. The telescoping jib as claimed in claim 1, wherein the at least one guying support comprises a plurality of guying supports with the jib basic box and each telescoping section each including a respectively one of the guying supports arranged thereon.

5. The telescoping jib as claimed in claim 4, wherein each guying support has an opening for the displaceable tension rods to be guided there through and the rod holder for the respective displaceable tension rod is arranged in a region of the opening.

6. The telescoping jib as claimed in claim 4, wherein a one of the guying supports is arranged on a head of the jib basic box and is guyed to the jib basic box in the region of a foot of the jib basic box via left and right, positionally fixed tension rods.

7. The telescoping jib as claimed in claim 5, wherein the rod holder comprises a movable locking bar via which the respective displaceable tension rod in the opening can be fixed in the operating position by engagement into a recess in the respective displaceable tension rod.

8. The telescoping jib as claimed in claim 7, wherein each guying support comprises two limbs which are arranged on the telescoping jib to the right and left of a center of the telescoping jib, as seen in the longitudinal direction of the telescoping jib, and form an angle of 45 degrees to 135 degrees.

9. The telescoping jib as claimed in claim 8, wherein at least one of the displaceable tension rods is fixedly articulated to each limb of each guying support and/or can be fixed to the rod holder.

10. The telescoping jib as claimed in claim 1, wherein the successive telescoping sections and the jib basic box can be secured to one another.

11. The telescoping jib as claimed in claim 1, wherein via an erector that connects the guide holders of the guying system to the jib basic box via one of the guying supports, the guide holders can be erected from a transport position to an operating position and, in the operating position, the guide holders and the displaceable tension rods resting thereon extend in parallel with a longitudinal direction and above the telescoping jib.

12. The telescoping jib as claimed in claim 11, wherein the guide holders can be pivoted from the transport position to the operating position via articulation points, the articulation points are arranged over the course of the guide holders and adjoining the guying support, the displaceable tension rods in the transport position on the guide holders have articulation points which are aligned with the articulation points of the guide holders.

13. The telescoping jib as claimed in claim 1, wherein the at least one guying support comprises a plurality of guying supports the jib basic box and each telescoping section each including a respective one of the guying supports arranged thereon.

14. The telescoping jib as claimed in claim 1, wherein each guying support comprises two limbs which are arranged on the telescoping jib to the right and left of a center of the telescoping jib, as seen in the longitudinal direction of the telescoping jib, and form an angle.

15. The telescoping jib as claimed in claim 14, wherein at least one displaceable tension rod is fixedly articulated to each limb of each guying support and/or can be fixed to the rod holder.

16. The telescoping jib as claimed in claim 1, wherein each guying support has an opening for the displaceable tension rods to be guided there through and the rod holder for the respective displaceable tension rod is arranged in a region of the opening.

17. The telescoping jib as claimed in claim 16, wherein the rod holder comprises a movable locking bar via which the respective displaceable tension rod in the opening can be fixed in the operating position by engagement into a recess in the respective displaceable tension rod.

18. A method for guying a telescoping jib of a mobile crane, wherein the telescoping jib comprises a plurality of telescoping sections configured to be telescoped out of a jib basic box from a transport position to an operating position, and a guying system comprising a plurality of successively mutually connected tension rods which extend from the jib basic box via at least one guying support to at least one of the extended telescoping jibs, wherein a guide holder for the tension rods is arranged on the jib basic box and receives the tension rods in the transport position of the telescoping jib and, in the operating position, in each case at least one of the displaceable tension rods on one of the guying supports is fixedly articulated in each case to an outer end of a telescoping section head and can be fixed to a rod holder on an opposite end on an adjacent guying support of an adjacent telescoping section head, such that the tension rods are guyed between the jib basic box and at least one adjoining telescoping section, said method comprising:

successively extending the individual telescoping sections from the jib basic box together with in each case extending one of the displaceable tension rods from a respective guide holder from transport position to the operating position and fixing each displaceable tension rod in the operating position to the guying support of the adjacent telescoping section via the respective rod holder.

19. The method of claim 18, wherein the rod holder comprises a movable locking bar via which the respective displaceable tension rod in the opening can be fixed in the operating position by engagement into a recess in the respective displaceable tension rod.

20. The method of claim 19, wherein each guying support is arranged in each case at an outer end of a jib basic box head or an outer end of the telescoping section head of the telescoping sections.

* * * * *